United States Patent [19]

Kameyama et al.

[11] Patent Number: 4,914,348

[45] Date of Patent: Apr. 3, 1990

[54] ELECTROLUMINESCENCE MULTI-COLOR DISPLAY DEVICE

[75] Inventors: Kenji Kameyama; Seiichi Oseto; Yoshiyuki Kageyama; Hiroshi Deguchi, all of Yokohama, Japan

[73] Assignee: Ricoh Company, Ltd., Tokyo, Japan

[21] Appl. No.: 279,054

[22] Filed: Dec. 2, 1988

[30] Foreign Application Priority Data

Dec. 3, 1987 [JP] Japan ..... 62-183777[U]
Dec. 14, 1987 [JP] Japan ..... 62-314164

[51] Int. Cl.[4] ..... H05B 33/04
[52] U.S. Cl. ..... 313/509; 313/512
[58] Field of Search ..... 313/505, 506, 509, 511, 313/512; 315/169.3; 340/718

[56] References Cited

U.S. PATENT DOCUMENTS 4,719,385 1/1988 Barrow et al. ..... 313/506
4,721,883 1/1988 Jacobs et al. ..... 313/511 X

*Primary Examiner*—Sandra O'Shea
*Attorney, Agent, or Firm*—Oblon, Spivak, McClelland, Maier & Neustadt

[57] ABSTRACT

An electroluminescence multi-color display device in which two electroluminescence panels each comprising an electrode layer, an insulation layer and a luminescence layer laminated on a glass substrate so as to enable dot matrix display are appended to each other so that each of the glass substrates is situated to the outer side, wherein a film-like insulation member having a strip-like pattern made of electroconductive material formed on one surface thereof is used as a lead electrode for each of said electroluminescence panels and said lead electrode is used as a spacer between the two electroluminescence panels.

3 Claims, 3 Drawing Sheets

ELECTROLUMINESCENCE MULTI-COLOR DISPLAY DEVICE

BACKGROUND OF THE INVENTION

The present invention concerns an electroluminescence multi-color display device (hereinafter referred to as an EL multi-color display device) and a method of manufacturing thereof.

EL multi-color display devices are generally grouped into those having luminescence layers of different luminescent colors disposed in a two dimensional manner and those disposed in three dimensional manner. Generally, the latter structure is excellent in view of the resolution power. The method of disposing the luminescence layers in three dimensional manner is further divided generally into two methods. One of them is a method of laminating EL elements having different luminescence colors in the three dimensional manner on one identical substrate, whereas the other of them is a method of preparing EL elements of respective colors on different substrates and appending them with each other.

When comparing both of them in view of the manufacturing method, although the latter method with less number of films to be formed on one substrate is excellent in view of the step of forming films on the glass substrate, it is necessary to dispose a spacer between each of the substrates in the actual mounting step in the display device for avoiding the contact between each of the EL elements upon appending the EL elements prepared on the respective substrates in the latter method. On the other hand, the spacer is not required in the former method.

In the prior art, easy manufacture upon film formation, that is, the step of actual mounting in the display device of appending different EL display panels to each other in the latter method has not yet been simplified.

Further, in a display device of a structure having two appended EL panels on the premise of the line sequential driving, when manufacturing a device adapted to be driven using corresponding electrodes on scanning side between the two EL panels in common, lead electrodes connected to the electrodes on the scanning side of respective EL panels are respectively connected in common upon mounting a driving device in the prior art method. However, this method involves a problems that the connection step for the electrode is complicated.

SUMMARY OF THE INVENTION

The object of the present invention is to simplify the structure of an EL multi-color display device in which different display panels are appended to each other.

According to the present invention, the above mentioned object is attained by an electroluminescence multi-color display device in which two electroluminescence panels each comprising an electrode layer, an insulation layer and a luminescence layer laminated on a glass substrate so as to enable line sequential driving are appended to each other such that each of said glass substrates is situated to the outside and scanning electrodes are in common to said two electroluminescence panels such that display addresses are in common with corresponding upper and lower picture elements, wherein a lead electrode is connected in common with the respective scanning electrodes in common to said two electroluminescence panels, said lead electrode comprising a film-like insulation member having one strip-like electrodes on one face thereof and the other strip-like electrodes on the other face thereof, said one strip-like electrodes and said other strip-like electrodes are identical in pattern and connected electrically with each other.

According to the present invention, since the lead electrodes and scanning electrodes used in common between the two EL display panels can be conducted at the same time in the connection step of the lead electrode to the electrode on scanning side, it is possible to simplify the manufacturing method and reduce the cost of products.

According to the present invention, the above mentioned object is attained by an above mentioned device, wherein the lead electrode is used as a spacer between the two electroluminescence panels.

According to the present invention, it is possible to save the step of disposing the spacer upon manufacturing the EL display device of a constitution in which two sheet of EL display panels are appended with each other and reduce the cost of products.

Further objects and advantages of the present invention will be apparent from the following description, reference being had to the accompanying drawings wherein preferred embodiments of the present invention are clearly shown.

DESCRIPTION OF THE PREFERRED EMBODIMENT

The present invention is to be described specifically referring to a display device having a structure in which two EL display panels are used and appended with each other.

Figure 1:
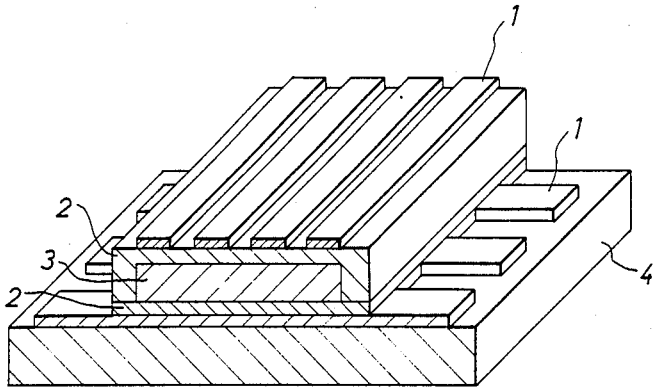
FIG. 1 is a perspective view, partially in cross section, of an EL display panel.

FIG. 1 illustrates an EL display panel constituting a display device by appending EL panels, comprising a transparent electrode 1, an insulation layer 2, a luminescence layer 3 and a glass substrate 4. FIG. 1 schematically shows the EL device in which the number of electrodes, etc. are not shown. Two sheets of such EL display panels are prepared. Since they are based on the line sequential driving method and use corresponding electrodes on the scanning side in common upon driving, the number of electrodes on the scanning side, width and pitch of the electrode wires are respectively made equal to each other. Further, referring to the electrode on the signalling side, the number of electrodes, the width and pitch of electrodes wires are respectively made equal to each other so as to constitute a display device in the appended structure.

In the present invention, there is no restrictions for each of the constituent elements. For instance, the material for the luminescence layer 3 may be ZnS, ZnSe, CaS, SrS, SrSe, CaSe and mixed crystals thereof. As the radiative center for the luminescence layer 3, Mn or lanthanum series rare earth is used. As the insulation layer 2, there can be used ferrodielectric materials, e.g., oxides such as $Y_2O_3$, $SiO_2$, $Al_2O_3$ and $Ta_2O_5$, nitride such as $Si_3N_4$, BN and AlN or tungsten-bronze system or perovskite system. Further, as the material for the transparent electrode 1, ITO, ZnO, etc. can be used.

The structure for the EL panel has a so-called insulated structure in which insulation layers 2 are disposed on both sides of the luminescence layer 3. The insulation layer 2 may also be disposed on one side of the luminescence 3, or a structure of not using the insulation layer 2 may also be used. In the present invention, there is no restriction also to the method of leading out electrodes. For instance, there can be used a method of leading out electrodes from one side of the glass substrate, or a method of grouping them into those of even numbers and odd numbers and taking out them respectively from opposite ends of the glass substrate.

The lead electrodes are connected by the method described below. For the connection of the electrodes on the signal side, a film-like insulating member having on one surface thereof a strip-like pattern made of electroconductive material with the same pitch and wire width as those of the electrode on signalling side is prepared as a lead electrode, and soldering the lead electrode to two EL display panels respectively, or interposing an anisotropic electroconductive film, etc. between the lead electrode and the EL panel and securing the EL panels from the outside by using jigs, etc.

For the connection to the scanning electrode, a lead electrode for the electrode on scanning side is used, the scanning electrode is aligned such that the display addresses of the two EL display panels are in common with the corresponding upper and lower picture elements, an anisotropic electroconductive film, etc. is interposed between the upper and lower electrode portions and then EL panels are secured from the outside by using jigs, etc.

The material for the lead electrode is not particularly limited. For instance, polyamide type film, etc. can be used as material for the insulation material, and copper foils, etc. can be used as the electroconductive material.

There is no particular restriction to the film thickness of the insulation material.

There is no particular restriction for the method of appending two EL panels. For instance, there can be used a method of appending them by coating adhesives to the inner side of the connecting portion for the lead electrode, a method of disposing jigs to the outside of the EL display panel and securing by means of pressing, etc. Furthermore, there is no particular restriction to the method of passivation in the present invention. For instance, a resin is coated to the inside of the connection portion of the lead electrode such that it surrounds the luminescence portion and seals the luminescence layer after appending, and filling moisture proofing oils such as silicone oil to the gap between the EL panels after curing.

Figure 2:
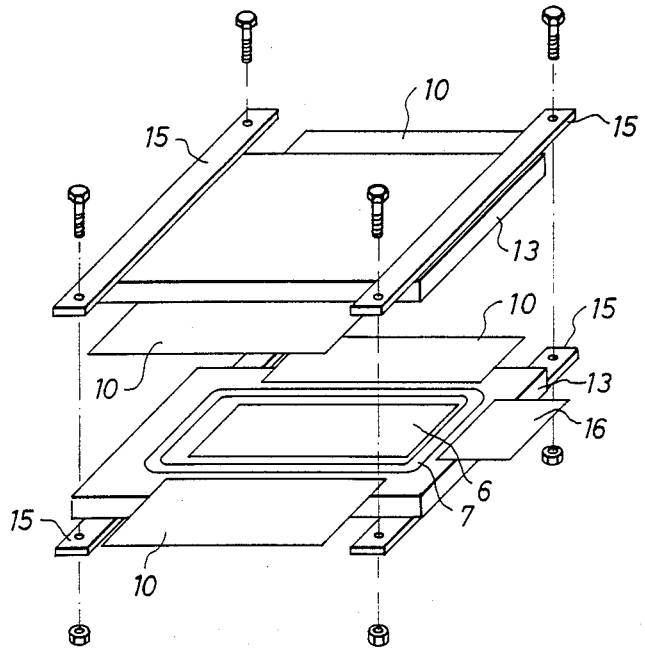
FIG. 2 is an explanatory view for the method of appending EL display panels using jigs.

FIG. 2 shows a constitutional view for appending EL panels by using jigs. In the figure, ae shown, an EL luminescence layer 6, adhesives 7, a lead electrode 10 on signalling side, a glass substrate 13, a fixing jigs 15, a lead electrode 16 on scanning side. In the present invention, there is no particular restriction except for using the method of driving the EL display device by line sequential driving and using those corresponding scanning lines of the two appended EL display panels in common. As a specific method of driving, there can be used AC driving method, for example, a field-refresh method of applying pulses of opposite polarities to the entire panel after the completion of writing for one picture frame and closing 1 AC cycle in one picture frame, p-n symmetric driving method of applying pulses upon writing while reversing the polarity on every picture frames and closing 1 AC cycle in two picture frames or asymmetric driving method using pulses of uni-polarity.

The present invention is to be described specifically referring to examples.

EXAMPLE 1

As an example of the present invention, a multicolor EL display device having a display capacity of 128 dot×128 dot using SrS : Ce and CaS : Eu respectively as the luminescence layer in the constitution of the device according to the present invention was manufactured. The details are to be described below.

(I) Manufacture of single luminescence layer EL display panel

An EL display panel having the structure as shown in FIG. 1 was manufactured by using SrS : Ce and Cas : Eu respectively as the luminescence layer. Each of the constituent layers shown by reference numerals in the Figure, materials used and manufacturing method are as described below.

(1) ZnO : Al transparent electrode 1

ZnO doped with 2 wt% of Al to a target by RF magnetron sputtering was used and a film of 2000 Å A thickness was formed at a substrate temperature of 300° C. Subsequently transparent electrodes were prepared at 3/mm (electrode wire width:200 μm) by etching. Electrodes on scanning side were led out from one side end of the glass substrate, while electrodes on signalling side at even numbers and odd numbers were led out respectively from each of opposite ends of a glass substrate.

(2) Insulation layer 2

A film of 3000–5000 Å thickness was formed by EB vapor deposition process using $Y_2O_3$ as a vapor deposition source at a substrate temperature of 70° C.

(3) CaS : Eu luminescence layer 3

A film of 1 μm thickness was formed by EB vapor deposition process using CaS doped with 0.1 mol% of $EuCl_3$ as a vapor deposition source at a substrate temperature of 500° C.

(4) SrS : Ce luminescence layer 3

A film of 1 μm was formed by EP vapor deposition process using SrS doped with 0.1 mol% of $CeCl_3$ as a vapor deposition source at a substrate temperature of 450° C.

(II) Connection of electrode on signalling side

Ni was vapor deposited with 5 mm width from the end of the glass substrate to each of the transparent electrodes, to which etching was applied along with the pattern of the electrode on signalling side. As the lead electrode to the transparent electrodes, strip-like electrodes made of copper foil (copper foil of 25 μm thickness, and the same wire width and pitch as those of the transparent electrode manufactured in (1) above. The base of a polyimide film of 25 μm thickness coated with pressure sensitive adhesives of 50 μm thickness) was prepared, applied with soldering at the end thereof with 3 mm width and then connected by means of hot press bonding along with the pattern of the transparent electrode.

(III) Connection of electrode on scanning side

The same electrode as used in (II) above was used as a lead electrode, which was double-holded. An anisotropic electroconductive film was interposed between the lead electrode and the scanning side electrode, jigs were attached to the outside and two EL display panels were fixed by pressing. After curing the adhesives, silicone oils were filled to the gap between the EL panels. For the driving method, field-refresh method was employed using EL driving drivers SN75551, 75552, 75553, 75554 manufactured by Texas Instruments Co.

Figure 3:
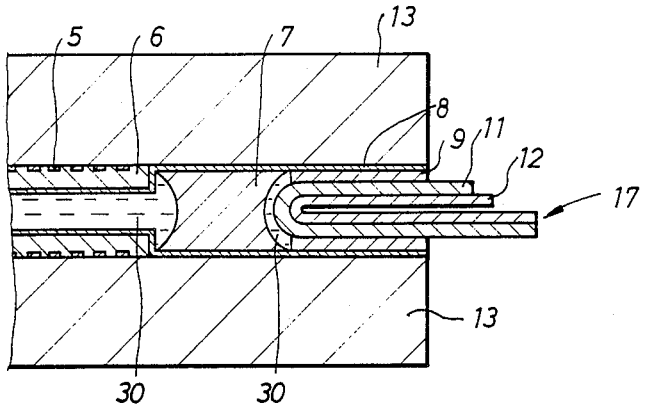
FIG. 3 is a cross sectional view for the portion of an electrode connection portion on the scanning side in Example 1.

FIG. 3 shows the cross sectional view for the connection portion of the electrode on scanning side according to this example. In the figure, are shown transparent electrodes 5 on signalling side, transparent electrodes 8 on scanning side, an anisotropic electroconductive film 9, a strip-like copper foil electrode 11, a polyimide film 12, and a lead electrode 17 on scanning side double-folded polyimide film on an outer side of which the copper foil electrode 11 is disposed.

EXAMPLE 2

As another example of the present invention, an EL display panel manufactured by the methods (I) and (II) described above was used, and strip-like copper foil electrodes (having identical wire width and pitch with those of the scanning side electrode and connected at the corresponding electrode patterns at the surface and the rear face on the side opposite to that connected with the EL display device respectively by means of wire bonding) were disposed by means of pressure sensitive adhesives (50 μm thickness) on both sides of a polyimide film (25 μm thickness) in an identical pattern both for the surface and the rear face was prepared as the connection method for the electrode on scanning side.

An anisotropic electroconductive sheet is interposed between two EL display panels, which were fixed under pressure by attaching jigs to the outside thereof as shown in FIG. 2. After curing the adhesive, silicone oils were filled to the gap between the EL panels. As the driving method, the method shown in Example 1 was used.

Figure 4:
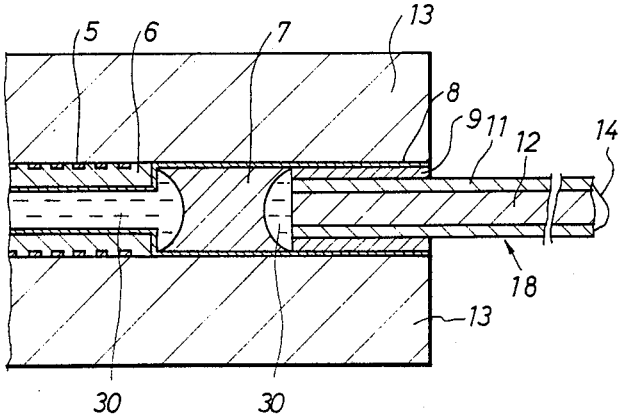
FIG. 4 is a cross sectional view for the portion of an electrode connection portion on the scanning side in Example 2.

FIG. 4 shows a cross sectional view for the connection portion of the electrode on scanning side in this example. In the Figure, are shown transparent electrodes 5 on signalling side, transparent electrodes 8 on scanning side, an anisotropic electro-conductive film 9, a strip-like copper foil electrode 11, a flat polyamide film 12, a lead electrode 17, a lead electrode 18 on scanning side, a gap 30, and wire members 14 for connecting electrodes on the surface and the rear face corresponding to the lead electrode by means of wire bonding.

As a result, the display quality was satisfactory both in Examples 1 and 2 and the step of electrode connection upon manufacturing could be simplified as compared with the conventional method.

EXAMPLE 3

As a further example of the present invention, a multi-color EL display device having a display capacity of 128 dot×128 dot using SrS : Ce and CaS : Eu respectively as the luminescence layer in the constitution of the device according to the present invention was manufactured. The details are to be described below.

(I) Manufacture of single luminescence layer EL display panel

An EL display panel having the structure as shown in FIG. 1 was manufactured by using SrS : Ce and Cas : Eu respectively as the luminescence layer. Each of the constituent layers shown by reference numerals in the Figure, materials used and manufacturing method are as described below.

(1) ZnO : A1 transparent electrode 1

ZnO doped with 2 wt% of A1 to a target by RF magnetron sputtering was used and a film of 2000 Å thickness was formed at a substrate temperature of 300° C. Subsequently, transparent electrodes were prepared at 3/mm (electrode wire width:200 μm) by etching. Electrodes on scanning side were led out from one end, while electrodes on signalling side at even numbers and odd numbers were led out respectively from the other end of a glass substrate.

(2) Insulation layer 2

A film of 3000–5000 Å thickness was formed by EB vapor deposition process using $Y_2O_3$ as a vapor deposition source at a substrate temperature of 70° C.

(3) CaS : Eu luminescence layer 3

A film of 1 μm thickness was formed by EB vapor deposition process using CaS doped with 0.1 mol% of $EuC1_3$ as a vapor deposition source at a substrate temperature of 500° C.

(4) SrS : Ce luminescence layer 3

A film of 1 μm thickness was formed by EB vapor deposition process using SrS doped with 0.1 mol% of $CeC1_3$ as a vapor deposition source at a substrate temperature of 450° C.

(II) Treatment of transparent electrode

Ni was vapor deposited with 5 mm width from the end of the glass substrate to each of the transparent electrodes, to which etching was applied along with the pattern of the transparent electrode.

(III) Connection of lead electrode

As a lead electrode having a function of a spacer in the present invention, strip-like electrodes made of copper foil (copper foil having 25 μm thickness, and identical wire width and pitch with those in the transparent electrode prepared in (1) above. The base used of a polyimide film of 25 μm thickness coated with pressure sensitive adhesive of 50 μm thickness) were prepared, applied with soldering with 3 mm width at the end thereof and then connected to the EL panels by means of press bonding under heating.

(IV) Appending and passivation of EL panels

Adhesives (one-component type adhesives) were coated to the inside of the lead electrode connection portion with 2 mm width and two EL panels were appended with each other while aligning the position for each of corresponding picture elements therein. After curing the adhesives, silicone oils were filled to the gap between the EL panels.

The multi-color EL display device according to this example was manufactured by the method described above. On the other hand, an EL display device using a spacer (polyimide film of 3 mm width, 0.5 mm thickness) by using the step described above as a comparison. As the driving method, field-refresh method was employed using EL driving drivers SN75551, 75552, 75553 and 75554 manufactured by Texas Instruments Co.

Figure 5:
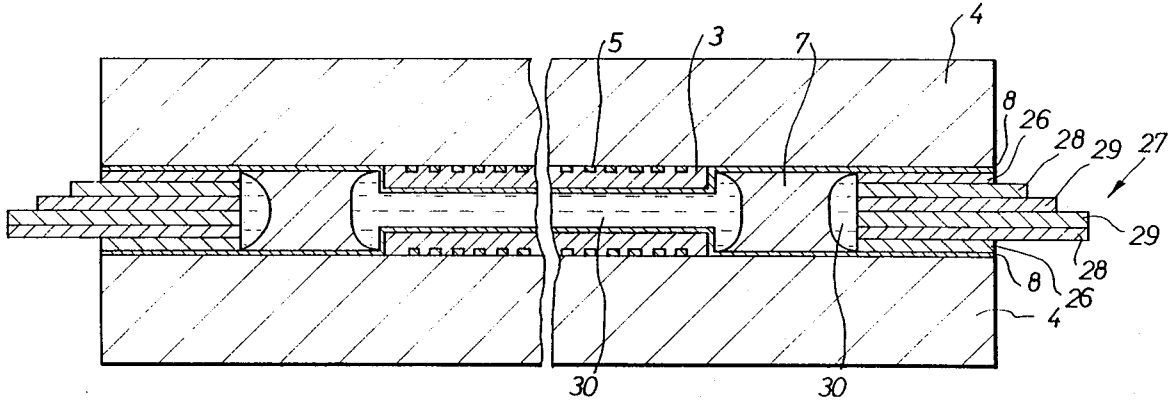
FIG. 5 is a cross sectional view for the portion of an electrode connection portion on the scanning side in Example 3.

FIG. 5 shows a cross sectional view for the electrode connection portion in this example. In the figure, are shown, respectively, transparent electrodes 5 on signalling side, transparent electrodes 8 on scanning side, a luminescence layer 3, a junction portion 26 between the transparent electrodes and the lead electrode, a lead electrode 27, an electroconductive film 28, an insulation film 29, a gap 30 and a glass substrate 4.

As a result, in a display device manufactured by the method of using the spacer in accordance with the present invention, a step of disposing the spacer can be saved and it is possible to reduce the cost of products and facilitate the manufacture of products as compared with the conventional manufacturing method.

Many widely different embodiments of the present invention may be constructed without departing from the sprit and scope of the present invention. It should be understood that the present invention is not limited to the specific embodiments described in this specification, except as defined in the appended claims.

What is claimed is:

1. An electroluminescence multi-color display device comprising:

two electroluminescence panels each having a glass substrate, a plurality of first strip-like electrode layers on signalling side each laminated on one face of said glass substrate and having a strip-like lead electrode connected thereto, a first insulation layer formed on said first strip-like electrode layers, a luminescence layer formed on said first insulation layer, a second insulation layer formed on said luminescence layer, and a plurality of second strip-like electrode layers on scanning side each laminated on said second insulation layer in a direction perpendicular to said first strip-like electrode layers, one panel and the other panel of said electroluminescence panels being appended with each other such that the second strip-like electrode layers of said one panel oppose through a gap to the second strip-like electrode layers of said other panel; and a plurality of double-folded film-like lead electrodes each interposed between an end portion of the second strip-like electrode layer of said one panel and an end portion of the second strip-like electrode of said other panel such that one picture element of said one panel defined by one display address of said one panel and the other picture element of said other panel defined by the same display address as said one display address are electrically connected to be simultaneously scanned.

2. An electroluminescence multi-color display device according to claim 1, wherein said double-folded film-like lead electrode comprises double-folded conductive films electrically connecting the second strip-like electrode layer of said one panel to the second strip-like electrode of said other panel and a double-folded film-like insulation member disposed inside said double-folded conductive films.

3. An electroluminescence multi-color display device according to claim 2, wherein said double-folded conductive films comprises an anisotropic electro-conductive film and a copper foil electrode disposed inside said anisotropic electro-conductive film.

* * * * *